US008581180B2

(12) United States Patent
Chapon et al.

(10) Patent No.: US 8,581,180 B2
(45) Date of Patent: Nov. 12, 2013

(54) METHOD AND DEVICE FOR MEASURING GLOW DISCHARGE SPECTROMETRY IN PULSED MODE

(75) Inventors: Patrick Chapon, Villebon sur Yvette (FR); Olivier Rogerieux, Verrieres le Buisson (FR); Agnes Tempez, Massy (FR)

(73) Assignee: Horiba Jobin Yvon SAS, Longjumeau (FR)

( * ) Notice: Subject to any disclaimer, the term of this patent is extended or adjusted under 35 U.S.C. 154(b) by 0 days.

(21) Appl. No.: 13/640,116

(22) PCT Filed: Apr. 14, 2011

(86) PCT No.: PCT/FR2011/050865

§ 371 (c)(1),
(2), (4) Date: Dec. 21, 2012

(87) PCT Pub. No.: WO2011/128600

PCT Pub. Date: Oct. 20, 2011

(65) Prior Publication Data

US 2013/0200257 A1 Aug. 8, 2013

(30) Foreign Application Priority Data

Apr. 15, 2010 (FR) ..... 10 52883

(51) Int. Cl.
*H01J 49/00* (2006.01)

(52) U.S. Cl.
USPC ..... 250/282; 250/281; 250/492.1; 250/493.1

(58) Field of Classification Search
USPC ..... 250/281, 282, 492.1–492.3, 493.1; 204/164; 331/127
See application file for complete search history.

(56) References Cited

U.S. PATENT DOCUMENTS

2009/0000942 A1 1/2009 Bai et al.
2009/0237170 A1 9/2009 Van Zyl et al.
2009/0294275 A1* 12/2009 Shannon et al. ..... 204/164

FOREIGN PATENT DOCUMENTS

WO 01/84591 A2 11/2001

OTHER PUBLICATIONS

International Search Report, corresponding application serial No. PCT/FR2011/050865, filed Apr. 14, 2011, now published as WO2011/128600A1 on Oct. 20, 2011.
Siqi Luo et al., "Experimental Study of Laser-Initiated Radiofrequency-Sustained High-Pressure Plasmas", IEEE Transactions on Plasma Science, IEEE Service Center, Piscataway, NJ, US, vol. 34, No. 6, Dec. 1, 2006, pp. 2637-2651.

(Continued)

*Primary Examiner* — Michael Maskell
(74) *Attorney, Agent, or Firm* — Brooks Kushman P.C.

(57) ABSTRACT

The present invention relates to a device for measuring glow discharge spectrometry in pulsed mode, which includes an RF electric field generator in pulsed mode, a discharge lamp, an impedance matching device for transferring the electric power supplied by the generator to the discharge lamp and a mass spectrometer suitable for measuring at least one signal representative of an ionised plasma species. According to the invention, the device includes a measurement system suitable for measuring a signal representative of the impedance mismatch ΔΩ between the generator and the discharge lamp, said measurement system including a fast acquisition system, synchronized with the pulses and suitable for supplying the impedance matching device with a signal representing the impedance mismatch ΔΩ for at least one part of said pulses. The device enables continuous impedance adaptation.

10 Claims, 3 Drawing Sheets

(56) References Cited

OTHER PUBLICATIONS

Valledor, R. et al., "Direct Chemical In-Depth Profile Analysis and thickness Quantification of Nanometer Multilayers Using Pulsed-RF-GD-TOFMS", Analytical and Bioanalytical Chemistry, Springer, Berlin, DE, vol. 396, No. 8, Jan. 16, 2010, pp. 2881-2887.

Zabeida, O. et al., "Time-Resolved Measurements of Ion Energy Distributions in Dual-Mode Pulsed-Microwave/Radio Frequency Plasma", Journal of Applied Physics, American Institute of Physics, New York, US, vol. 88, No. 2, Jul. 15, 2000, pp. 635-642.

* cited by examiner

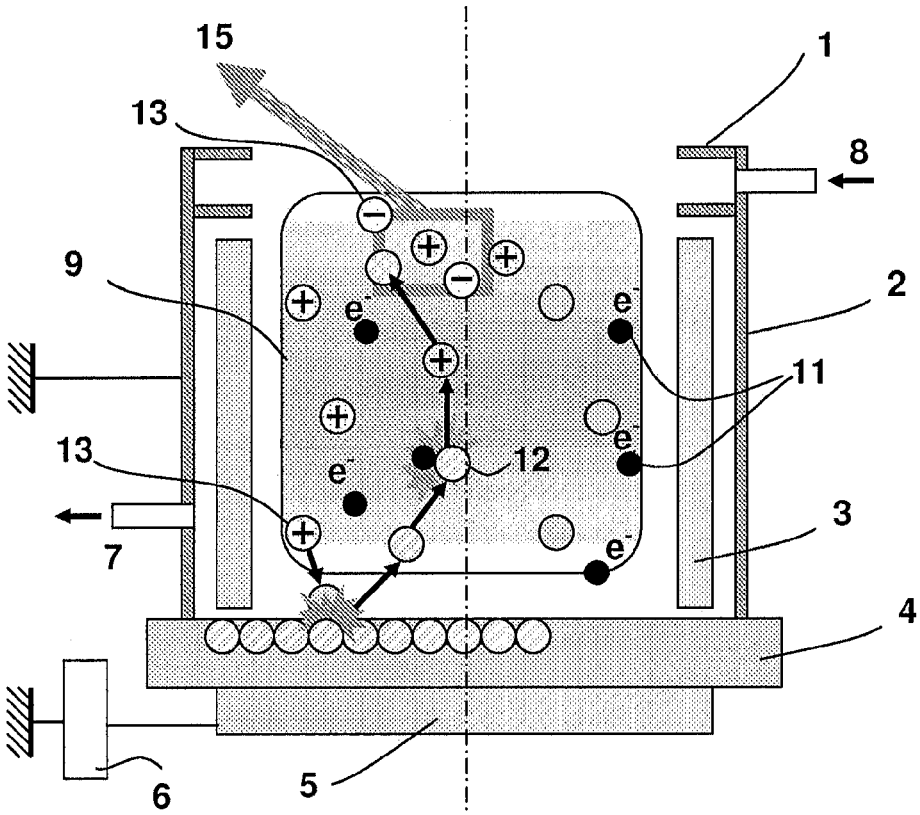
Prior Art Figure 1
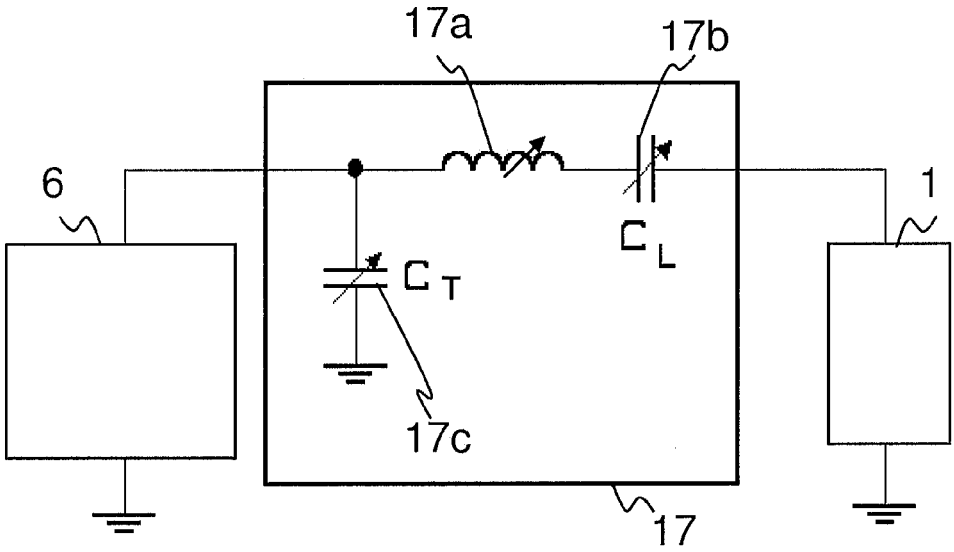
Prior Art Figure 2

METHOD AND DEVICE FOR MEASURING GLOW DISCHARGE SPECTROMETRY IN PULSED MODE

CROSS-REFERENCE TO RELATED APPLICATION

This application is the U.S. national phase of PCT Appln. No. PCT/FR2011/050865 filed on Apr. 14, 2011, which claims priority to French Patent Application No. 1052883 filed on Apr. 15, 2010, the disclosures of which are incorporated in their entirety by reference herein.

The present invention relates to a method and a device for pulsed glow discharge spectrometry measurement. Glow discharge spectrometry is used for the quantitative analysis of the elemental chemical composition of solid samples or stacks of thin films, wherein such analysis can be in-depth resolved.

In a glow discharge spectrometer, a sample to be analysed is exposed to an etching plasma that carries out a surface ablation. Moreover, the plasma, via various physico-chemical mechanisms, excites and ionises the eroded species. The follow-up of the species present in the plasma, by an optical spectrometer for excited species and/or by a mass spectrometer for ionised species, allows obtaining the chemical composition profile of a sample as a function of the depth of erosion, with a sub-micron resolution.

Initially limited to the materials and to the conductive layers due to the use of direct current (DC) sources, glow discharge spectrometry now allows analysing semiconductor and insulating materials thanks to the use of radiofrequency (RF) sources.

Glow discharge spectrometers (GDS) are known. A GDS apparatus generally comprises a mechanical device called a "lamp", in which is placed a sample to be analysed, the lamp body being connected to an optical and/or mass spectrometer. FIG. 1 is a schematic cross-sectional view of a discharge lamp according to the prior art. The discharge lamp 1 comprises an anodic tube 3 inside a vacuum chamber 2. A sample 4 placed in the lamp, facing an end of the anodic tube 3 forms the second electrode of the device. A pumping system 7 operates to produce a primary vacuum in the lamp, and a gas 8, called the "carrier gas" (generally argon), is introduced under low pressure. An electric generator 6 operates to apply an electric field to the electrodes of the lamp and to generate a plasma 9 consisted of electrons 11, neutral atoms in a fundamental or excited state 12, and ionised species 13, with the plasma 9 remaining confined inside the anodic tube 3. Through ion bombardment, the plasma 9 erodes the sample surface opposite the end of the anodic tube, in such a way to form at the sample surface a crater whose diameter is close to the diameter of the anodic tube. The ionised species 13 present in the plasma 9 are measured by a mass spectrometer 15 and/or the excited species are measured by an optic spectrometer. More particularly, a mass spectrometer comprises a mass analyser that separates the ions as a function of their mass/charge ratio (m/z), where m is the atomic mass and z is the electric charge of an ionised species. A glow discharge spectrometer then allows analysing materials and thin films. However, the GDL sources having high erosion rates (of the order of 2 to 100 nm per second), it is necessary to have spectrometers allowing a fast acquisition and providing multi-elemental information. This may be obtained using a multi-channel optical spectrometer and/or an extremely fast time-of-flight mass spectrometer. The combination of an optical spectrometer with a mass spectrometer is also contemplated and has been made in experimental fittings.

In a RF glow discharge spectrometer, a RF generator provides the electric power to the discharge lamp, for example by means of a RF applicator 5 in contact with the sample 4. The RF generator has an output impedance of 50 ohms. The generator must in principle be always connected to an electric circuit whose impedance is adapted to the output impedance of the generator, i.e. 50 ohms. An impedance matching device placed between the electric generator and the discharge lamp operates to adapt the output impedance of the generator to the impedance of the electric system formed by the discharge lamp, the plasma and the sample. However, the impedance of the electric system varies as a function of both the conditions of the plasma and the nature of the sample.

In a non-pulsed RF glow discharge spectrometer, the impedance matching device is slaved to an impedance mismatch measurement system, based for example on a measurement of the reflected power. The thus-slaved impedance matching system allows optimizing the power transfer to the plasma while minimizing the reflected power.

An impedance matching device generally comprises electric components of variable capacitance and/or variable inductance for setting the impedance of the device. The power provided by the generator being relatively high (from a few Watts to a hundred of Watts), the variable-impedance components are generally components of the electromechanical type, such as variable capacitors or variable inductance coils that are compatible with the power delivered over an extended range of impedance variation. FIG. 2 schematically shows an exemplary embodiment of a known impedance matching system 17 comprising an inductance coil 17*a* and two variable capacitors 17*b*, 17*c*. A mechanical control operates to modify the impedance value of a component (capacitance or impedance) so as to modify the real part (ReΩ) and the imaginary part (ImΩ) of the matching device impedance. The known variable capacitors are, for example, plate capacitors whose distance is mechanically variable. A known variable impedance coil is for example a coil whose electric contact point varies in such a way to modify the number of turns used. The impedance matching devices are modelled in the literature by complex notations (real and imaginary values), and two parameters have to be controlled to minimize the reflected power. The impedance matching may be performed manually by an operator before the GDS measurements are started or be motor-driven so as to slave the position of the electromechanical components to a measurement of the power reflected by the sample and/or of the current-voltage phase shift.

In a non-pulsed RF glow discharge spectrometer, a slaved impedance matching device thus allows minimizing the reflected power and bringing the current-voltage phase shift closer to 0 degree at the start of and during the spectrometric measurements. However, the impedance matching process is necessarily slow due, on the one hand, to the slowness of the system for measuring a signal representative of the impedance mismatch, and on the other hand, to the slowness of the electromechanical impedance matching device. The response time for obtaining an impedance match is of the order of 0.5 to 10 seconds.

An impedance matching device may possibly be coupled to a frequency excursion device that allows modifying the frequency of the generator and modifying the impedance mismatch. A frequency excursion device has a fast response time, of the order of 0.1 s. However, it allows modifying only one electric parameter and does not always allow, on its own, fully minimizing the reflected power.

Another way to compensate for an impedance mismatch consists in increasing the power provided by the RF generator. However, the additional power delivered clears up in particular as thermal energy liable to induce a thermal stress in the sample. The presence of a cooling circuit in contact with the sample is not always sufficient to reduce the thermal heating induced on the sample, even for an optimized power, in particular in case of fragile materials or multi-layer samples, for which thermal stress may be detrimental.

In the last years, the major advance in glow discharge spectrometry has been made thanks to the introduction of pulsed RF sources. A pulsed RF source, by optimizing the pulse cyclic ratio, allows the instantaneous power, which is responsible for the material erosion and for the obtaining of the analytic signals, and the mean power provided to the sample, which is responsible for the thermal heating thereof, to be controlled independently from each other.

In glow discharge optical spectrometry, the main benefit of using a pulsed RE source lies in the minimization of the thermal stresses induced, in particular for the fragile materials.

In glow discharge mass spectrometry, the use of a pulsed RF source offers remarkable additional advantages because the mechanisms of ionisation of the species present in the plasma vary during the period of the RF source. FIG. 3A schematically shows the power $P_f$ provided by the RF generator to generates an electric pulse 20 during a time $\tau_1$. FIG. 3B schematically shows a measurement obtained by mass spectrometry just before the beginning of the electric pulse, during the pulse and after this electric pulse has been stopped. The mass spectrometry signal may be analysed over different time zones called "prepeak" 31, "plateau" 32 and "afterglow" 33, respectively, offering analytic combinations that are original and rich in information, not only for the fragile materials but for any type of materials and stacks of thin films. In FIG. 3B, the two curves shown in full line and in dash line, respectively, correspond to the follow-up by a mass analyser of two different elements, for example the carrier gas for the full line curve and an element coming from the sample for the dash line curve.

More precisely, the ionic signals appear generally more intense in the "afterglow" zone 33 after the extinction of a plasma pulse. The publication of N. Tuccito et al. (Rapid Comm. Mass Spectrom. 2009, 23: 549-556) indicates that the time distribution of the maxima of mass spectrometry signals is peculiar to each element. This publication also demonstrates that it is not only possible to optimize the measurement of each element with a time-of-flight mass spectrometer, but also to analyse ionised molecular fragments, which allows discriminating polymers having similar elemental compositions but different molecular structures. The publication of L. Lobo et al. (A Comparison of non-pulsed radiofrequency and pulsed radiofrequency glow discharge orthogonal time-of-flight mass spectrometry for analytical purposes, J. Anal. At. Spectrom., 2009, 24, 1373-1381) has shown that it is possible to obtain with glow discharge mass spectrometry signal/background ratios, and thus sensitivities, which are far higher in pulsed mode than those obtained in continuous (not-pulsed) mode. Moreover, the publication of Lobo et al. highlights that a precise selection of the time interval of integration in pulsed mode allows optimizing the performance in terms of ionic separation and of precision and reproducibility of the isotope ratio measurements.

It appears today quite decisive to be able to carry out simultaneous or quasi-simultaneous mass spectrometry measurements (as in the time-of-flight apparatuses) in pulsed mode.

However, in the case of a multi-layer sample, for example, the impedance of the material changes as a function of the depth of erosion. Moreover, the impedance matching systems have a very high response time and the impedance mismatch measurement systems are intended for continuous signals. The slaved impedance matching devices existing up to now do not operate satisfactorily in pulsed mode because they generally bring about an erratic movement of the electromechanical components of the matching box and do not allow minimizing the reflected power at start or at a layer change. The solution to avoid such erratic movements of the electromechanical components of the matching box and thus erratic changes of impedance is generally to inhibit the system for the slaving of the matching box. The operator wishing to optimize the measurements has thus to proceed through a series of tries and errors, by pre-setting the impedance matching device at fixed positions, so as to minimize the reflected power at start, then compensating for the small differences by increasing the incident power during erosion of the sample. Such try-and-error method may be destructive for the sample, which is sometimes available in only one specimen. Moreover, increasing the power applied necessarily induces a thermal stress in the sample, while one of the goals of using the pulsed mode is just to reduce the thermal stress induced.

It up to now exists no impedance matching device nor impedance mismatch measurement system that allow a real-time slaving of the impedance matching with a response time lower than 0.5 s and that are capable of transmitting an electric power up to 200 W. It up to now exists no impedance matching and impedance mismatch measurement system that is compatible with an operation of the RF generator in pulsed mode.

The present invention aims to remedy these drawbacks and to improve a method and a device for pulsed mass spectrometry measurement. The invention aims in particular to optimize the coupling of the electric power to a glow discharge mass spectrometer operating in pulsed mode, while reducing the thermal stress induced, in particular for multi-layer samples.

The present invention more particularly relates to a method for the measurement of a solid sample by pulsed glow discharge spectrometry, comprising:

a) applying a pulsed RF electric field at the terminals of the electrodes of a glow discharge lamp in the presence of a carrier gas and a sample to be analysed, said lamp being electrically coupled to an impedance matching device having a variable electric impedance $\Omega$, so as to generate a pulsed glow discharge plasma, the duration of an electric pulse being equal to $\tau_1$, the pulse repetition frequency being equal to $F_1$ and the cyclic ratio of a pulse being equal to $\tau_1 \times F_1$;

b) measuring by mass spectrometry at least one signal representative of a ionised species having a predetermined m/z ratio, said measurement being carried out at an acquisition frequency $F_2$ higher than $1/\tau_1$;

c) measuring a signal representative of the impedance mismatch $\Delta\Omega$ between the pulsed RF electric field generator and the electrodes of the discharge lamp during at least one part of the plasma pulses by means of a fast measurement acquisition system synchronised with said pulses, said fast acquisition system having an acquisition frequency $F_3$ higher than $1/\tau_1$;

d) determining an impedance variation $d\Omega$ to be applied to the impedance matching device as a function of the measurement of a signal representative of the impedance mismatch $\Delta\Omega$;

e) modifying the impedance $\Omega$ of the impedance matching device as a function of the value of $d\Omega$ determined at step d);

f) repeating steps c) to e) so as to minimize the impedance mismatch $\Delta\Omega$.

According to various aspects, the method of the invention further comprises one or several of the following steps:

the measurement of a signal representative of the impedance mismatch $\Delta\Omega$ comprises a measurement of the reflected electric power and/or a measurement of the current-voltage phase shift;

the variations of the real part $Re(\Omega)$ and the imaginary part $Im(\Omega)$ of the impedance $\Omega$ of said matching device are obtained by modifying the impedance values of at least two components of the matching device;

excursion of the RF frequency of the generator so as to minimize the impedance mismatch $\Delta\Omega$.

According to a preferred embodiment of the method of the invention, the pulse repetition frequency $F_1$ is comprised between 0.1 kHz and 20 kHz, and the pulse cyclic ratio $\tau_1 \times F_1$ is comprised between 5% and 50%.

The present invention also relates to a glow discharge spectrometry device comprising:

a RF electric field generator operable in pulsed mode, capable of generating a RF electric field comprising electric pulses of duration $\tau_1$ and of repetition frequency $F_1$;

a discharge lamp comprising electrodes, pumping means and means for introducing a carrier gas, said discharge lamp being capable of receiving a solid sample to be analysed and of generating a glow discharge plasma;

a mass spectrometer connected to said discharge lamp and capable of measuring at least one signal representative of a ionised species of the plasma having a predetermined m/z ratio, at an acquisition frequency $F_2$ higher than $1/\tau_1$; and an impedance matching device electrically connected, on the one hand, to the pulsed RF electric field generator, and on the other hand, to the electrodes of the discharge lamp, said matching device being capable of transferring the electric power provided by the pulsed RF generator to the discharge lamp and said matching device having a variable electric impedance $\Omega$.

According to the invention, the glow discharge spectrometry device comprises a measurement system capable of measuring a signal representative of the impedance mismatch $\Delta\Omega$ between the generator and the discharge lamp, said measurement system comprising a fast acquisition system, synchronised with the plasma pulses, having an acquisition frequency $F_3$ higher than or equal to $1/\tau_1$ and being capable of providing the impedance matching device with a signal representative of the impedance mismatch $\Delta\Omega$ for at least one part of said pulses.

According to a preferred embodiment, the matching device adapts the impedance $\Omega$ as a function of the measurement representative of the impedance mismatch, so as to continuously minimize the impedance mismatch $\Delta\Omega$.

According to various aspects of the spectrometry device of the invention:

the impedance matching device comprises at least two variable capacitance and/or variable inductance electromagnetic components, capable of modifying the real part $Re(\Omega)$ and the imaginary part $Im(\Omega)$ of the impedance $\Omega$ of said matching device;

the spectrometry device further comprises a frequency excursion device capable of varying the RF frequency of the generator and slaved to the measurement of the impedance mismatch $\Delta\Omega$;

the impedance mismatch measurement system comprises a measurement of the reflected electric power and/or a measurement of the current-voltage phase shift;

the mass spectrometer is a time-of-flight spectrometer or a four-pole spectrometer or a magnetic sector spectrometer or a Fourier transform mass spectrometer.

The invention will find a particularly advantageous application in the glow discharge mass spectrometry operating in pulsed mode.

The present invention also relates to the characteristics that will be revealed by the following description and that will be considered either alone or in any technically possible combination thereof.

Such description, given by way of non-limitative example, will allow a better understanding of how the invention can be implemented, with reference to the appended drawings, in which:

FIG. 1 is a schematic cross-sectional view of a glow discharge lamp according to the prior art;

FIG. 2 is a schematic view of an electric circuit for coupling between an electric generator, an impedance matching system and a discharge lamp according to the prior art;

The structure and the operation of a pulsed RF glow discharge spectrometry apparatus according to an embodiment of the invention will now be described.

Figure 5:
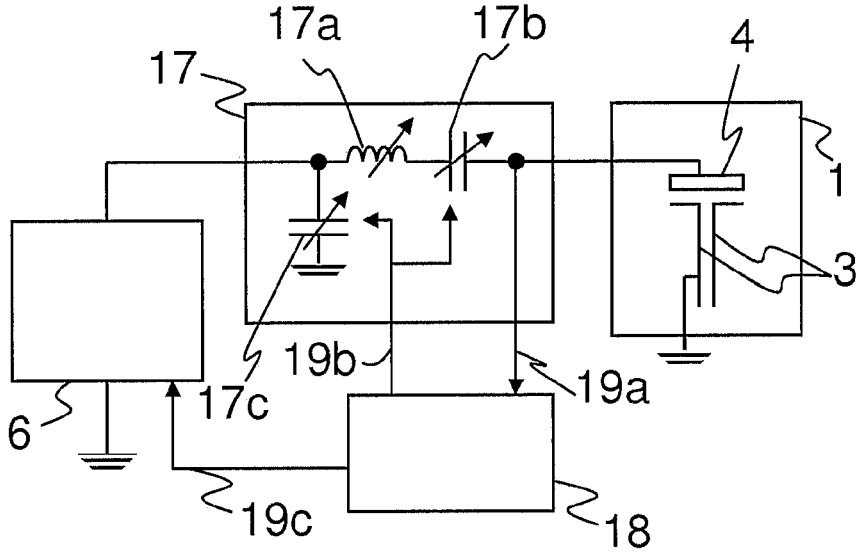
FIG. 5 is a schematic view of an electric circuit for coupling between an electric generator, a discharge lamp, an impedance matching system and a system for the slaving of the impedance and/or the frequency excursion according to an embodiment of the invention.

FIG. 5 is a schematic view of a glow discharge spectrometry apparatus that comprises an electric generator 6, an impedance matching device 17, a discharge lamp 1 and an impedance mismatch measurement system 18.

The discharge lamp 1 is a conventional lamp such as, for example, the discharge lamp described in detail with reference to FIG. 1. The discharge lamp 1 comprises a tubular electrode 3. A sample 4 to be analysed forms the second electrode. A RF applicator operates to transmit the power delivered by the generator to the discharge lamp, through the sample.

The electric generator 6 is a RF generator that may operate in continuous mode or in pulsed mode. The electric generator 6 delivers a maximum RF power of 150 W. The RF frequency of the generator is generally the standard frequency of 13.56 MHz. However, RF generators operating at other RF frequencies and compatible with the principle of operation described in detail hereinafter also exist.

Figure 3:
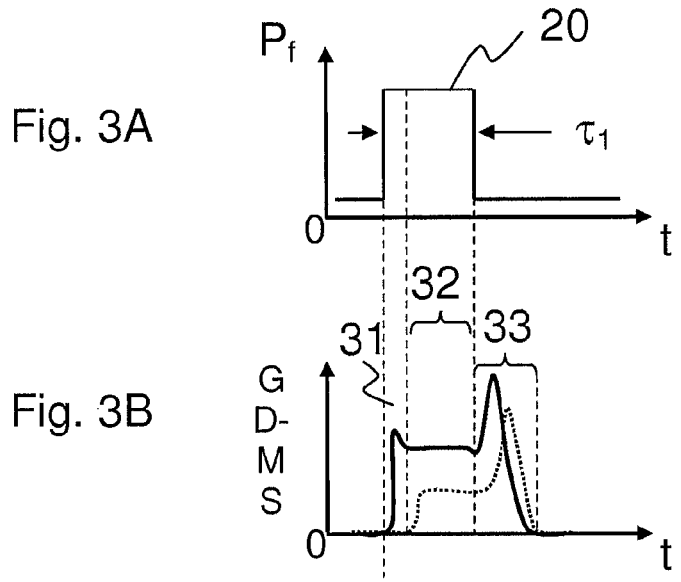
FIG. 3A is a schematic view of a pulse applied by a pulsed generator as a function of time.
FIG. 3B is a schematic view of two time signals obtained by mass spectrometry for two distinct elements and indicates the three respective measurement zones: "prepeak", "plateau" and "afterglow"
Figure 4:
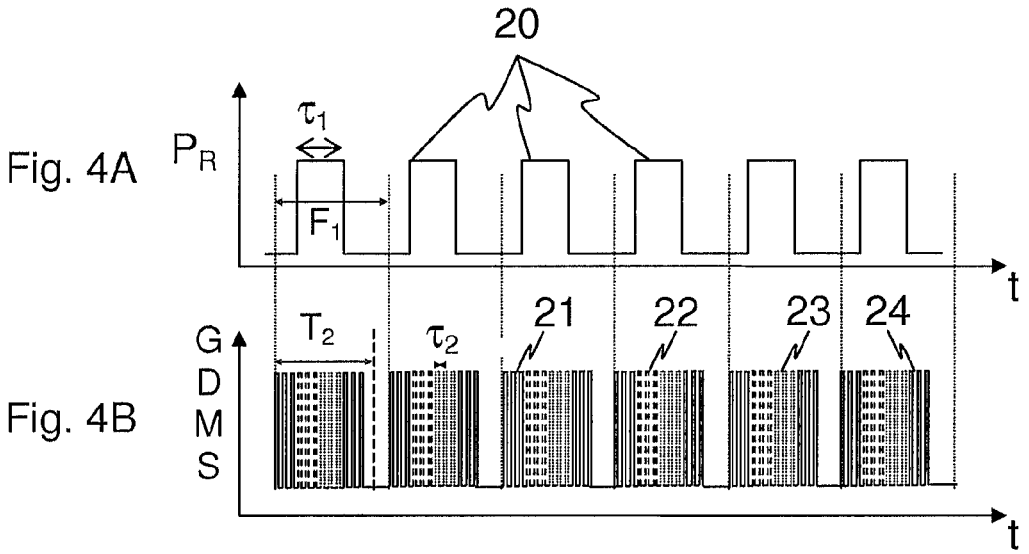
FIG. 4A is a schematic view of a series of electric pulses of duration $\tau_1$ and of repetition frequency $F_1$.
FIG. 4B is a schematic view of a series of digital acquisitions corresponding to the different zones of mass spectrometry measurement.

FIG. 4A schematically shows the electric power $P_R$ provided by the pulsed RF generator. The generator 6 delivers pulses of duration $\tau_1$ and of repetition frequency $F_1$ (the variations due to the RF frequency are not shown in FIG. 4, because the RF frequency is extremely high compared to the pulse repetition frequency and to the pulse duration). In pulsed mode, the pulse repetition frequency $F_1$ may be fixed to a value generally comprised between 0.1 kHz and 20 kHz, and the pulse cyclic ratio $\tau_1 \times F_1$ may be set to a value typically comprised between 5% and 50%. The duration of a pulse is thus generally comprised between a few microseconds and a few seconds. The more the cyclic ratio is low, the more the risk of sample heating is reduced. FIG. 4B is a schematic view of the sequence of pulsed mass spectrometry acquisition. Digital acquisitions are also carried out at a frequency $F_2$ equal to $1/\tau_2$, far higher that the frequency $1/\tau_1$, so as to acquire enough spectra in the "prepeak", "plateau" and "afterglow" zones, respectively, of each period of the RF source. A sequence of acquisition by the detector of the mass spectrometer extends over a duration $\tau_2$ longer than the duration $\tau_1$ of a pulse of the RF generator. As illustrated in FIG. 4B, a sequence of acquisition of the mass spectrometer starts a little before the electric pulse, so as to acquire the base line of the mass spectra before the beginning of the pulse (zone 21), then continues at the beginning of the pulse ("prepeak" zone 22), during the pulse ("plateau" zone 23), and finally ends after the end of the pulse, so as to acquire spectra ("afterglow" zone 24). At each acquisition, the mass analyser allows obtaining simultaneously or quasi-simultaneously the intensity of the signals as a function of the m/z ratio, which allows deducing therefrom an in-depth resolved, multi-elemental and/or molecular chemical analysis of the sample.

By construction, the RF generator has an output impedance of 50 ohms. The generator is connected to an electric circuit whose impedance has, in principle, to be always adapted to the output impedance of the generator, i.e. 50 ohms, to optimize the transfer of electric power between the generator and the plasma. The impedance of the load connected to the generator is formed by the impedances in series (or in parallel according to the electric circuit) of the discharge lamp 1, the plasma 9, the sample 4 and the impedance matching device 17. However, as described in detail hereinabove, this impedance varies as a function of both the conditions of the plasma and the nature of the sample. In practice, the impedance of the discharge lamp 1 varies a little, while the impedance of the sample 4 varies during the measurement. Table I indicates the experimentally measured impedances for various types of samples. It can be observed, on the one hand, that the impedance of a sample in a glow discharge lamp is essentially of capacitive nature, and on the other hand, that the impedance value varies significantly according to whether the sample is a conductor, semiconductor or insulating material. Moreover, for a multi-layer sample, the sample impedance varies during the GD-MS measurement, as a function of the layer exposed to the plasma.

TABLE I

Complex impedance of various materials

| Material | Complex impedance |
|---|---|
| Steel 1261 | 22Ω-j427Ω |
| Painted steel | 25Ω-j281Ω |
| Semiconductor | 53Ω-j338Ω |
| Metallized glass | 48Ω-j535Ω |
| Thick ceramic | 40Ω-j500Ω |
| Glass | 33Ω-522Ω |
| Aluminium sheet | 46Ω-j314Ω |

FIG. 5 is a schematic view of the electric circuit connecting the pulsed RF electric field generator 6 to the glow discharge lamp 1. The glow discharge spectrometry device uses a conventional impedance matching device 17 placed between the generator 6 and the system formed by the discharge lamp 1 and the sample 4. The impedance matching device 17 comprises, for example, an inductance coil 17*a* and two capacitors 17*b*, 17*c*, of variable capacitances ($C_T$, $C_L$), i.e. a series capacitor 17*b* and a parallel capacitor 17*c*, respectively. The impedance matching box has an impedance Ω that varies as a function of the respective values of the capacitances ($C_L$, $C_T$) of the capacitors 17*b*, 17*c* and of the inductance of the coil 17*a*. In a first example, the capacitance of a capacitor is mechanically variable, for example by reducing the distance between the plates of a capacitor (vacuum capacitor, for example) or by modifying the inter-plate surface (fin capacitor, for example). In a second example, a component of the impedance matching system is replaced by two components: for example the variable capacitor 17*b* is replaced by two parallel capacitors, a high-capacitance capacitor and a low-capacitance capacitor. The motorization of the low-capacitance capacitor allows a fast response, whereas the parallel high-capacitance capacitor allows an adaptation to the strong variations of impedance with a longer response time. In another embodiment, the impedance matching system comprises two inductance coils that can be mechanically varied by modifying the electric contact point of the circuit and thus the number of turns used for each coil. The variable capacitors allow a continuous variation of impedance, whereas the systems of variable impedance have incremental variations of impedance. Such systems are robust and support high electric powers (several tens or even hundreds of Watts). However, the variation of impedance is controlled by a mechanical movement, which remains slow, even when it is motor-driven.

The innovative part of the device shown in FIG. 5 lies in the impedance mismatch measurement device 18 and in the slaving of the impedance matching system 17 to this measurement device 18 during the application of a pulsed RF electric field.

In the non-pulsed RF apparatuses, the impedance matching system 17 is continuously slaved to an analog measurement representative of the impedance mismatch, as for example a measurement of the reflected power, and/or a measurement of the current-voltage phase shift. The impedance of the components of the matching system 17 is modified by a mechanical movement that is relatively slow compared to the pulse duration in pulsed mode and compared to the pulse repetition frequency (from 10 Hz to 20 kHz).

However, when the generator 6 operates in pulsed mode, a conventional continuously-slaved system is incompatible with the operation in pulsed mode.

In the prior mass spectrometry apparatuses operating in pulsed mode, the slaving between the impedance matching system and the analog impedance mismatch measurement system is deactivated to avoid the erratic movement of impedance of the matching box.

The device of the invention comprises a device 18 connected to the impedance matching device 17. According to the preferred embodiment of the invention, a device 18 is used, which comprises a fast digital system for measuring a signal representative of the impedance mismatch ΔΩ. According to an exemplary embodiment, the intensity of the reflected electric power $P_r$ and/or the current-voltage phase shift is measured at high rate, wherein the duration of measurement of the reflected power or of the current-voltage phase shift is very far lower than the duration of the shortest pulses. The measurement of these control signals is made synchronously with the plasma pulses, so as to take into account only the signals measured when the plasma is turned on. The system for acquiring a measurement representative of an impedance mismatch (reflected power and/or current-voltage phase shift) is symbolically shown in FIG. 5 by the link 19*a* between the output of the impedance matching device 17 and the input of the system 18. Therefore, one or several values representative of the impedance mismatch ΔΩ are acquired, at a high acquisition frequency, for each electric pulse, i.e. for each plasma pulse.

A calculator operates to determine of what quantity the real part (ReΩ) and the imaginary part (ImΩ) of the impedance matching device have to be varied to minimize the impedance mismatch and to minimize the reflected power, according to a predetermined slaving algorithm. A previous calibration thus allows determining what movement(s) has(have) to be applied to the electromechanical components to modify their respective impedance by the determined value. The slaving algorithm of the calculator may be based on a function proportional to the measured impedance mismatch ΔΩ, to correct the observed errors, and/or on a differential function, as a function of the variation rate of ΔΩ, so as to anticipate impedance mismatch variations.

The slaving between the measurement device 18 and the matching device is symbolically shown by the link 19*b*, which allows acting on the value of the capacitors 17*b*, 17*c* as a function of the measurement, for example of the reflected power. The feedback loop formed by the two links 19*a* and 19*b* allows minimizing, for example, the reflected power $P_r$, and then obtaining the impedance match between a pulsed RF generator 6 and the load thereof consisted of the discharge lamp, the plasma and the sample.

Optionally, the measurement device may also allow acting on the generator 6 by frequency excursion, via the link 19*c*, so as to minimize a measurement representative of the impedance mismatch. The frequency excursion modifies the nominal RF frequency of 13.56 MHz by +/−300 kHz.

The device of the invention thus allows acting on an impedance matching device coupled to a pulsed RF generator, although this impedance matching device has an extremely slow response time compared to the pulse durations and to the time interval between two successive pulses.

Figure 6:
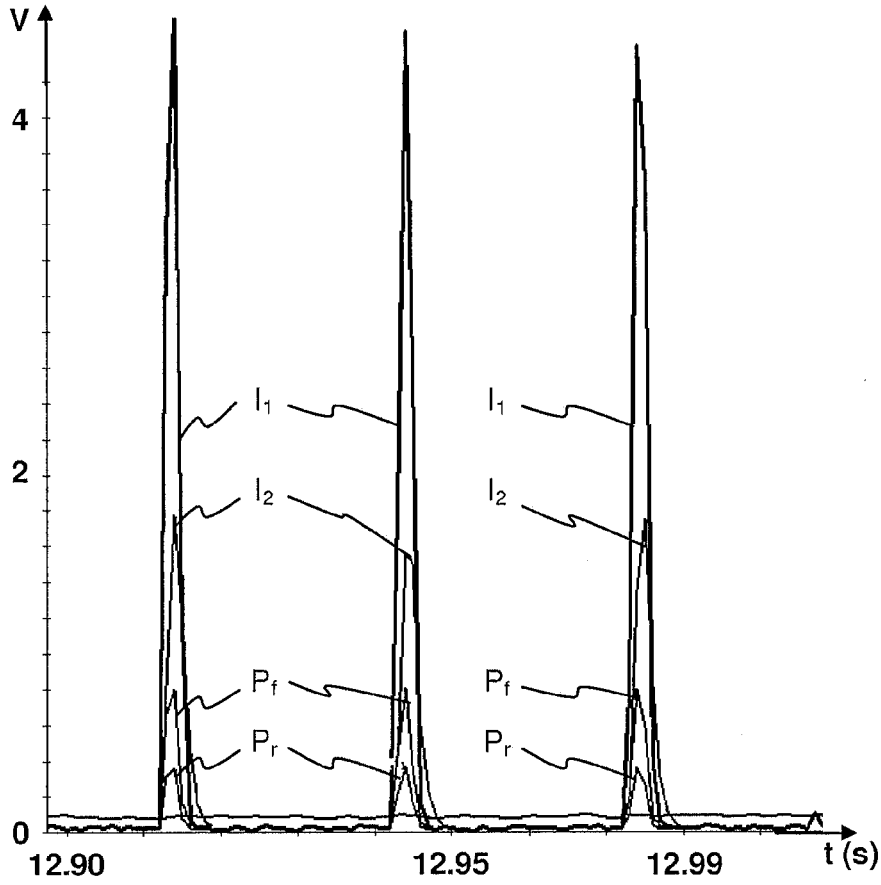
FIG. 6 is a view of a time measurement of intensity of the electric power applied during a series of electric pulses, as well as a fast digital measurement of a signal representative of the reflected power, as well as signals of optical spectrometry.

FIG. 6 shows a series of plasma pulses as a function of time, as well as the measurements of the incident and reflected power. The curves $I_1$ and $I_2$ show signals of optical spectrometry analysis, which have maxima during the plasma pulse. The curve $P_f$ shows a measurement of the power provided by the RF generator, i.e. the incident power. The curve $P_r$ shows a measurement of the reflected power. The ordinate scale is of arbitrary units. The measurements of incident power $P_f$ and reflected power $P_r$ between two successive pulses are filtered. Only the power measurements taken during the pulses are kept. The reflected power and/or current-voltage phase shift acquisitions allow controlling the reflected power and also minimizing the reflected power through a feedback toward the impedance matching system that slaves the values of the variable capacitors and/or inductors. The modification of the impedance of the impedance matching device is not effective during the pulse in which the measurement is carried out, due to the response time of the mechanical movements for setting the impedances of the matching device. The modification of impedance is carried out in a continuous way over a cycle of several pulses. In the case where the impedance matching box comprises mechanically variable capacities, the capacitances (17*b*, 17*c*) are varied in a continuous way, which smoothes the variations of impedance. As a function, on the one hand, of the repetition frequency and the cyclic ratio of the pulses, and on the other hand, of the response time of the matching system, the impedance modification may occur several pulses after the mismatch measurement. From one pulse to the other, a gradual minimisation of the reflected power $P_f$ slaved, as a function of time, to the evolution of the impedance of the discharge lamp and of the sample, may thus be obtained. Therefore, it is not a real time slaving. The continuous impedance adaptation corresponds well to the analysed materials, because, even in the case where the interfaces are neat, there is a progressive transition from one layer to another one.

Nevertheless, the method and the device of the invention allow an impedance adaptation in pulsed mode in conditions where the power transfer is optimized. The optimisation of the power transfer, and in particular the minimization of the reflected power, allows protecting the sample from a dissipation of energy as heat. This optimization also allows protecting the generator because the power reflected toward the electric generator risks damaging the latter.

The digital device for measuring the impedance mismatch and for controlling the impedance matching system may operate in continuous mode or in pulsed mode. This device allows adapting the impedance at the start of the measurement and during one measurement, in particular at each interface of a multi-layer sample.

The extraction frequency of the mass spectrometer is of the order of 30 kHz, i.e. very higher than the pulse repetition frequency, so as to extract a profile comprising enough points for each pulse. The mass spectrometry measurements are averaged over a predetermined number of source periods according to the in-depth resolution required to form a series of mass spectra of the sample. The evolution of the signal of one or several ionic species as a function of time allows constructing the profile of the analysed sample.

An extremely powerful pulsed mass spectrometry apparatus operating in pulsed mode is thus obtained.

The discharge lamp may possibly be coupled to an optical spectrometer for optical emission measurements.

The method and the device of the invention allow optimizing the pulsed impedance matching, although the impedance matching system can remain based on components (variable capacitor(s) and/or inductor(s)) whose impedance variation is controlled by a slow mechanical movement.

The method and the device of the invention allow performing analyses, by pulsed glow discharge mass spectrometry, in conditions where the impedance adaptation of the plasma is optimized as a function a measurement taken only during the pulses, which allow the optimal transfer of the power toward the plasma in pulsed mode, without increasing the power that is provided.

The method and the device of the invention avoid a test on a sample to optimize the start conditions of impedance adaptation, which limits the losses of samples, in particular when the sample to be analysed is of small size or fragile.

The method and the device of the invention allow analysing fragile samples, without inducing harmful thermal stress, and precisely analysing multi-layer samples, without drift of the matching conditions at the transitions between layers. The method of the invention therefore allows obtaining measurements with a best precision, a best in-depth resolution and/or a higher rapidity, over a wide range of impedance adaptation, compared to an impedance-slaved non-pulsed RF method, and also compared to a pulsed RF method without impedance slaving.

The method and the device of the invention allow not only improving the analytical performances of a GD-MS apparatus, but also efficiently protecting the RF generator thanks to the efficient minimisation of the power reflected by the generator, liable to deteriorate the electric generator.

The invention claimed is:

1. A method for the measurement of a solid sample by pulsed glow discharge spectrometry, comprising:

a) applying a pulsed RF electric field at the terminals of the electrodes of a glow discharge lamp in the presence of a carrier gas and a sample to be analysed, said lamp being electrically coupled to an impedance matching device having a variable electric impedance Ω, so as to generate a pulsed glow discharge plasma, the duration of an electric pulse being equal to $\tau_1$, the pulse repetition frequency being equal to $F_1$ and the cyclic ratio of a pulse being equal to $\tau_1 \times F_1$;

b) measuring by mass spectrometry at least one signal representative of a ionised species having a predetermined m/z ratio, said measurement being carried out at an acquisition frequency $F_2$ higher than $1/\tau_1$;

c) measuring a signal representative of an impedance mismatch $\Delta\Omega$ between a pulsed RF electric field generator and electrodes of the discharge lamp during at least one part of the plasma pulses using a fast measurement acquisition system synchronised with said pulses, said fast acquisition system having an acquisition frequency $F_3$ higher than $1/\tau_1$;

d) determining an impedance variation $d\Omega$ to be applied to the impedance matching device as a function of the measurement of a signal representative of the impedance mismatch $\Delta\Omega$;

e) modifying the impedance $\Omega$ of the impedance matching device as a function of the value of $d\Omega$ determined at step d);

f) repeating steps c) to e) so as to minimize the impedance mismatch $\Delta\Omega$.

2. The method of measurement according to claim 1, wherein the measurement of a signal representative of the impedance mismatch $\Delta\Omega$ comprises a measurement of at least one of a reflected electric power and a measurement of a current-voltage phase shift.

3. The method according to claim 1, wherein variations of a real part $Re(\Omega)$ and an imaginary part $Im(\Omega)$ of the impedance $\Omega$ of said matching device are obtained by modifying impedance values of at least two components of the matching device.

4. The method according to claim 1 further comprising changing RF frequency of the generator so as to reduce the impedance mismatch $\Delta\Omega$.

5. The method according to claim 1, wherein the pulse repetition frequency $F_1$ is comprised between 0.1 kHz and 20 kHz, and the pulse cyclic ratio $\tau_1 \times F_1$ is comprised between 5% and 50%.

6. A glow discharge spectrometry device comprising:

a RF electric field generator operable in pulsed mode, capable of generating a RF electric field comprising electric pulses of duration $\tau_1$ and of repetition frequency $F_1$;

a discharge lamp comprising electrodes, pumping means and means for introducing a carrier gas, said discharge lamp being capable of receiving a solid sample to be analysed and of generating a glow discharge plasma;

a mass spectrometer connected to said discharge lamp and capable of measuring at least one signal representative of a ionised species of the plasma having a predetermined m/z ratio, at an acquisition frequency $F_2$ higher than $1/\tau_1$;

an impedance matching device electrically connected, on the one hand, to a pulsed RF electric field generator, and on the other hand, to electrodes of the discharge lamp, said matching device being capable of transferring the electric power provided by the pulsed RF generator toward the discharge lamp and said matching device having a variable electric impedance $\Omega$; and, a measurement system configured to measure a signal representative of an impedance mismatch $\Delta\Omega$ between the pulsed RF generator and the discharge lamp, said measurement system comprising a fast acquisition system, synchronised with the plasma pulses, having an acquisition frequency $F_3$ higher than or equal to $1/\tau_1$ and being capable of providing the impedance matching device with a signal representative of the impedance mismatch $\Delta\Omega$ for at least one part of said pulses.

7. The device according to claim 6, wherein the impedance matching device comprises at least two variable capacitance and/or variable inductance electromagnetic components, capable of modifying the real part $Re(\Omega)$ and the imaginary part $Im(\Omega)$ of the impedance $\Omega$ of said matching device.

8. The device according to claim 6 further comprising a frequency excursion device capable of varying RF frequency of the generator and slaved to the measurement of the impedance mismatch $\Delta\Omega$.

9. The device according to claim 6, wherein the impedance mismatch measurement system comprises a measurement of reflected electric power and/or a measurement of the current-voltage phase shift.

10. The device according to claim 6, wherein the mass spectrometer is a time-of-flight spectrometer or a four-pole spectrometer or a magnetic sector spectrometer or a Fourier transform mass spectrometer.

* * * * *